US008123059B2

(12) United States Patent
Shimamoto et al.

(10) Patent No.: US 8,123,059 B2
(45) Date of Patent: Feb. 28, 2012

(54) SYNTHETIC RESIN BOTTLE HAVING TWO DEPRESSIONS DEFINING A GRIP

(75) Inventors: Keiji Shimamoto, Tokyo (JP); Masaaki Sasaki, Tokyo (JP); Tadayori Nakayama, Tokyo (JP)

(73) Assignee: Yoshino Kogyosho Co., Ltd, Tokyo (JP)

( * ) Notice: Subject to any disclaimer, the term of this patent is extended or adjusted under 35 U.S.C. 154(b) by 81 days.

(21) Appl. No.: 12/451,729

(22) PCT Filed: May 27, 2008

(86) PCT No.: PCT/JP2008/059732

§ 371 (c)(1),
(2), (4) Date: Dec. 31, 2009

(87) PCT Pub. No.: WO2008/146814

PCT Pub. Date: Dec. 4, 2008

(65) Prior Publication Data

US 2010/0102024 A1 Apr. 29, 2010

(30) Foreign Application Priority Data

May 29, 2007 (JP) ..... 2007-142380
May 29, 2007 (JP) ..... 2007-142394

(51) Int. Cl.
*B65D 23/10* (2006.01)
*B65D 1/02* (2006.01)

(52) U.S. Cl. ..... 215/384; 215/383; 215/398; 220/771

(58) Field of Classification Search ..... 215/379, 215/382–384, 396, 398; 220/771
See application file for complete search history.

(56) References Cited

U.S. PATENT DOCUMENTS 5,598,941 A * 2/1997 Semersky et al. ..... 215/384
6,223,920 B1 * 5/2001 Lane et al. ..... 215/384
6,273,282 B1 * 8/2001 Ogg et al. ..... 215/381
D448,304 S * 9/2001 Cheng et al. ..... D9/539
6,814,248 B2 * 11/2004 Beck et al. ..... 215/384
(Continued)

FOREIGN PATENT DOCUMENTS

JP Y2 4-23765 6/1992
(Continued)

OTHER PUBLICATIONS

Search Report issued for International Application No. PCT/JP2008/059732 on Jun. 24, 2008.

(Continued)

*Primary Examiner* — Sue Weaver
(74) *Attorney, Agent, or Firm* — Oliff & Berridge, PLC

(57) ABSTRACT

A synthetic resin bottle including a body having a bottom, wherein the body is divided by a waist into an upper body portion and a lower body portion. The bottle is easily portable and operable without requiring an additional handle, etc. and has high buckling strength. The bottle has a dome-shaped upper body portion connected, with the waist in between, to the lower body portion having the bottom, a shoulder surrounding the upper end of the upper body portion, and a tubular neck part connected to the shoulder. Two depressions facing each other are arranged on the rear side of the upper body portion along its circumferential direction. The portion formed between the depressions functions as a grip, and vertical ribs are each provided on a step surface formed on the front side of each depression.

8 Claims, 6 Drawing Sheets

U.S. PATENT DOCUMENTS

| | | | | |
|---|---|---|---|---|
| D525,527 | S * | 7/2006 | Ogg | D9/516 |
| 7,080,748 | B2 * | 7/2006 | Sasaki et al. | 215/384 |
| 7,118,002 | B2 * | 10/2006 | Saito et al. | 215/384 |
| D612,253 | S * | 3/2010 | Shimamoto et al. | D9/543 |
| 2004/0195200 | A1 * | 10/2004 | Bourque et al. | 215/384 |
| 2005/0218107 | A1 * | 10/2005 | Sabold et al. | 215/382 |
| 2005/0252881 | A1 * | 11/2005 | Zhang et al. | 215/384 |
| 2006/0207962 | A1 * | 9/2006 | Coley et al. | 215/384 |

FOREIGN PATENT DOCUMENTS

| | | |
|---|---|---|
| JP | A 2002-154517 | 5/2002 |
| JP | A 2002-160717 | 6/2002 |
| JP | A 2002-225831 | 8/2002 |
| JP | A 2006-8190 | 1/2006 |
| JP | A 2006-321568 | 11/2006 |
| JP | A 2009-536598 | 10/2009 |
| WO | WO 02/081313 A1 | 10/2002 |
| WO | WO 2007/128451 A1 | 11/2007 |

OTHER PUBLICATIONS

U.S. Appl. No. 29/274,641, filed May 11, 2007 in the name of Keiji Shimamoto et al.

U.S. Appl. No. 29/274,640, filed May 11, 2007 in the name of Keiji Shimamoto et al.

Notification of Reasons for Refusal issued in Japanese Patent Application No. 2007-142380; mailed Oct. 18, 2011; with English-language translation.

* cited by examiner

SYNTHETIC RESIN BOTTLE HAVING TWO DEPRESSIONS DEFINING A GRIP

TECHNICAL FIELD

The present invention relates to a synthetic resin bottle including a body having a bottom, in which the body is divided by a waist into an upper body portion and a lower body portion, and more specifically, to a technology for preventing a compression buckling that tends to be caused particularly in the upper body portion due to a compression stress along an axial direction of the bottle.

BACKGROUND ART

There is known a synthetic resin bottle that includes a body having a bottom and a circular cross section, in which the body is divided by a waist into an upper body portion and a lower body portion, as well as a modified bottle wherein, for example, a plurality of waists are provided on the upper body portion. Refer, for example, to the pamphlet of International Publication WO2002/081313.

DISCLOSURE OF THE INVENTION

Problem to be Solved by the Invention

Moreover, in the above-mentioned conventional bottle, two depressions are provided on the rear side of the upper body portion, in which the depressions are opposed to each other along its circumferential direction so as to define a grip therebetween, which makes it possible readily to carry the bottle and spout the content. That is to say, the above-mentioned conventional bottle has easy portability and operability, without requiring a separate handle, etc.

However, in such a bottle, if a large compression stress is applied along the axial direction of the bottle, the compression buckling may occur in the upper body portion. It is desired that such compression buckling is prevented as much as possible, since the compression buckling makes the appearance of the bottle worse.

The problem underlying the present invention is that, in the synthetic resin bottle including the body having the bottom, in which the body is divided by the waist into the upper body portion and the lower body portion, occurrence of a compression buckling in the upper body portion is to be avoided even if a large compression stress is applied along the axial direction of the bottle. It is an object of the present invention to provide a synthetic resin bottle having easy portability and operability and also having a high buckling strength, without requiring provision of an additional handle, etc.

Means for Solving the Problem

The present invention provides a synthetic resin bottle including a body having a bottom, in which the body is divided by a waist into an upper body portion and a lower body portion, wherein the bottle has two depressions which are provided on a rear side of the upper body portion and opposed to each other along its circumferential direction to define a grip therebetween, and at least one vertical rib or vertical groove provided on a step surface formed at each of front sides of the depressions.

It is noted that the term "rib" or "groove" in conjunction with a synthetic resin bottle manufactured basically by blow molding process may be generally interpreted, as being limited to a rib or groove with an increased or decreased wall thickness. However, in the context of the present invention, these terms should be given a broader interpretation as encompassing a raised portion or a recessed portion having a substantially uniform thickness.

It is preferred that the lower body portion has a prismatic shape.

It is also preferred that a concave region connecting the two depressions is provided at a front side of the upper body portion, and at least one raised portion or recessed portion is provided on the concave region.

It is further noted that the term "raised portion" or "recessed portion" in conjunction with the synthetic resin bottle manufactured basically by blow molding process may be generally interpreted, as being limited to a raised portion or a recessed portion with a substantially uniform thickness. However, in the context of the present invention, these terms should be given a broader interpretation as encompassing a rib or groove with an increased or decreased wall thickness.

Moreover, the upper body portion of the present invention may annularly extend along the upper end of the waist, with its diameter reduced at a constant rate, or the upper body portion may annularly extend along the upper end of the waist with its diameter reduced to provide a dome-shape, etc. However, it is preferred that the upper body portion annularly extends along the upper end of the waist with its diameter reduced to provide the dome-shape.

It is also preferred that at least one transverse groove or transverse rib is provided on the back face of the grip.

In the present invention, when at least one transverse groove or transverse rib is provided on the back face of the grip, these transverse grooves or transverse ribs may be arranged at intervals in the axial direction of the bottle as a matter of course, or at intervals in a circumferential direction. Also, both of the transverse groove and transverse rib may be arranged in combination, or in a random manner.

According to present invention, it is also preferred that the back face of the grip has a concaved surface curved along the axial direction of the bottle and concaved toward inside of the bottle. In this instance, according to the present invention, the concaved surface may have a curvature radius that is constant or variable to provide a desired curve satisfying various consumer needs, etc.

Effects of the Invention

According to the present invention, the rear side of the upper body portion is provided with two depressions opposed to each other along the circumferential direction to define the grip between the depressions, such that the grip functions as a beam of the upper body portion.

In addition, according to the present invention, at least one vertical rib or vertical groove is provided on the step surface formed at each of the front sides of the depressions, whereby the vertical rib or vertical groove also functions as a beam of the grip or, in other words, as a beam of the upper body portion.

Therefore, even if a large compression stress is applied along the axial direction of the bottle, the present invention serves to provide an improved strength of the entire upper body portion which otherwise tends to be easily buckled.

In addition, the lower body portion has the prismatic shape, of which each corner functions as a beam of the lower body portion. That is to say, according to the present invention, the strength of the lower body portion is also secured.

Therefore, the present invention provides a synthetic resin bottle having easy portability and operability and having high buckling strength, without requiring an additional handle, etc.

Moreover, in the present invention, when the concave region connecting the two depressions is provided at the front side of the upper body portion, and at least one raised portion or recessed portion is provided on the concave region, the concave region and the raised portion or the recessed portion disperse the compression stress, so as to provide a further improved strength against compression buckling.

Furthermore, according to the present invention, at least one transverse groove or transverse rib is provided on the back face of the grip, whereby the stiffness of the grip is increased. As a result, when a user holds the grip securely, the grip is prevented from deformation, whereby the portability and operability of the bottle can be further improved. Thus, when the volume of the bottle is enlarged, or when the wall thickness of the bottle is reduced, the portability and operability of the bottle remain intact to provide an excellent usability of the bottle.

In addition, according to the present invention, the concaved surface is provided on the back face of the grip, as being curved along the axial direction of the bottle and concaved toward the inside of the bottle, so as to provide a further improved stiffness of the grip. Also, the concaved surface formed on the back face of the grip allows the palm of the user to fit the concaved surface when the user holds the grip.

Thus, when the back face of the grip is provided with the concaved surface, the portability and operability of the bottle can be further improved.

BRIEF DESCRIPTION OF DRAWINGS

FIG. 1 is a front view of a PET bottle in accordance with first embodiment of the present invention, wherein:

REFERENCE SYMBOLS

1 PET bottle
2 Lower body portion
2*a* Shorter side (front face, back face)
2*b* Longer side (side face)
2*c* Corner
3 Waist
4 Upper body portion
4*a* Depression
4*d* Dimple (recessed portion)
4*r* Vertical rib
5 Shoulder
6 Tubular neck part
D Transverse groove
f1 Step surface at each front side of the depressions
f2 Concave region of the body
G Grip

DESCRIPTION OF EMBODIMENTS

Hereinafter, a preferred embodiment of the present invention will be concretely described with referent to the drawings.

Figure 1:
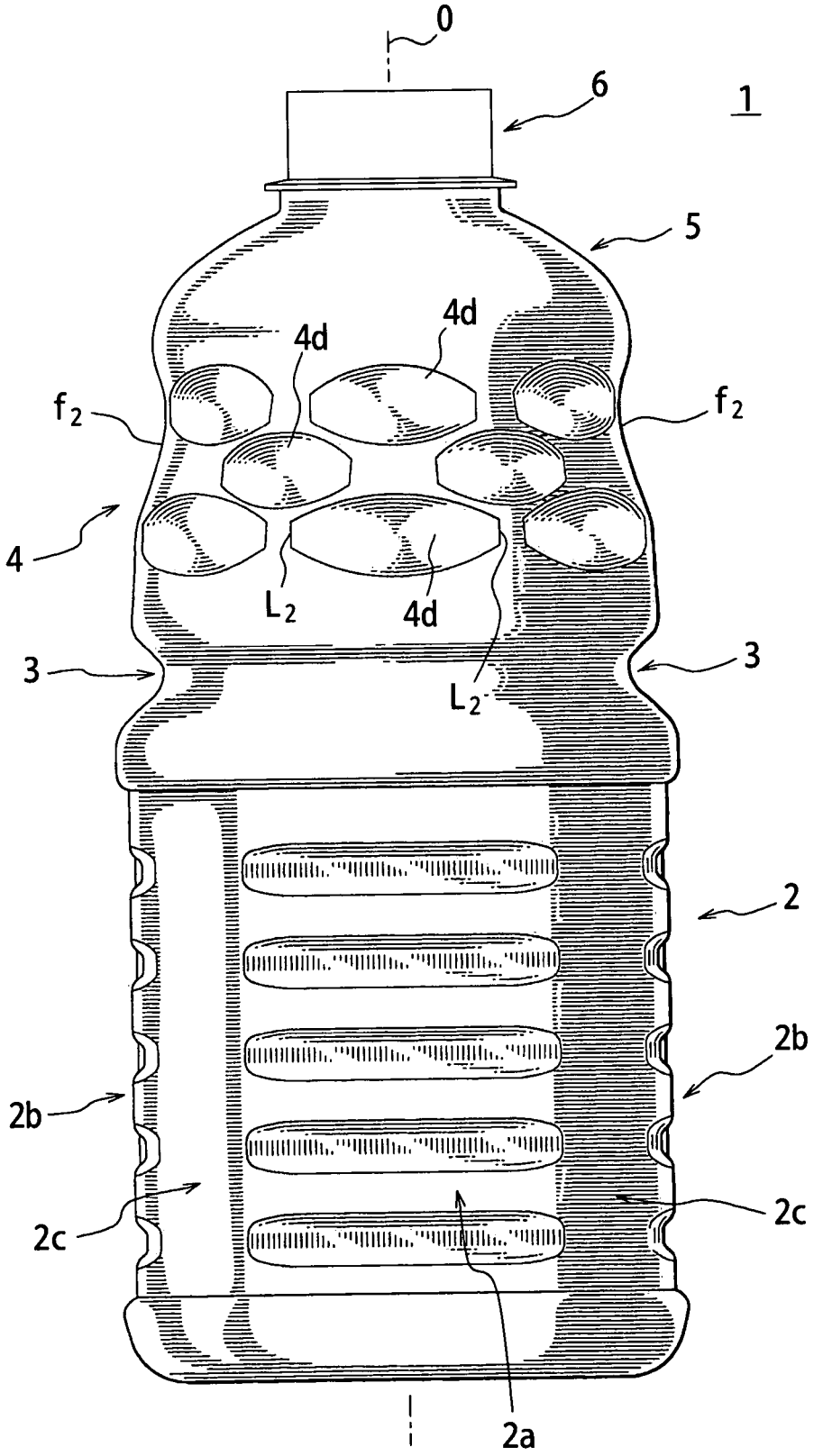
Figure 2:
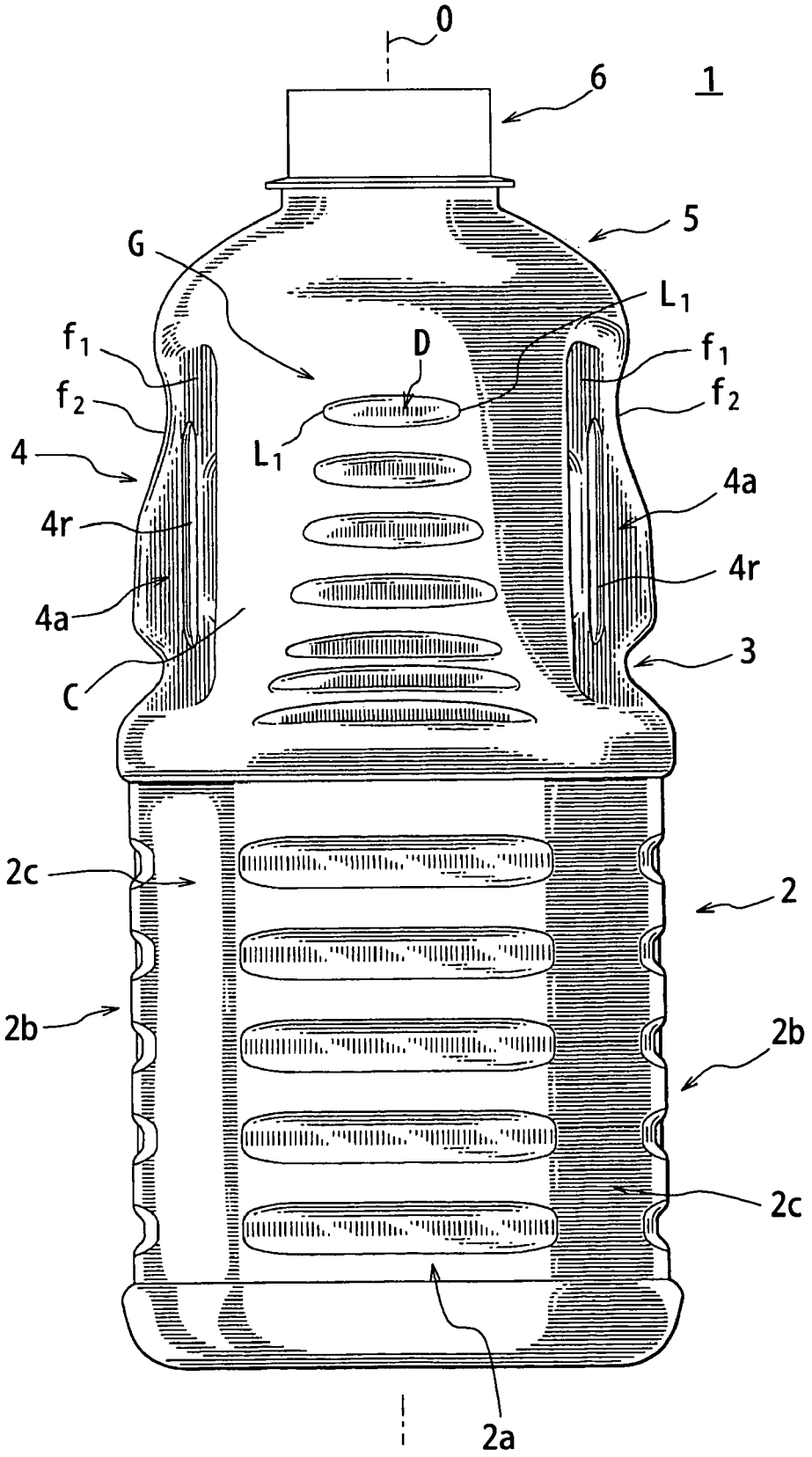
FIG. 2 is a rear view of the PET bottle in accordance with the embodiment.
Figure 3:
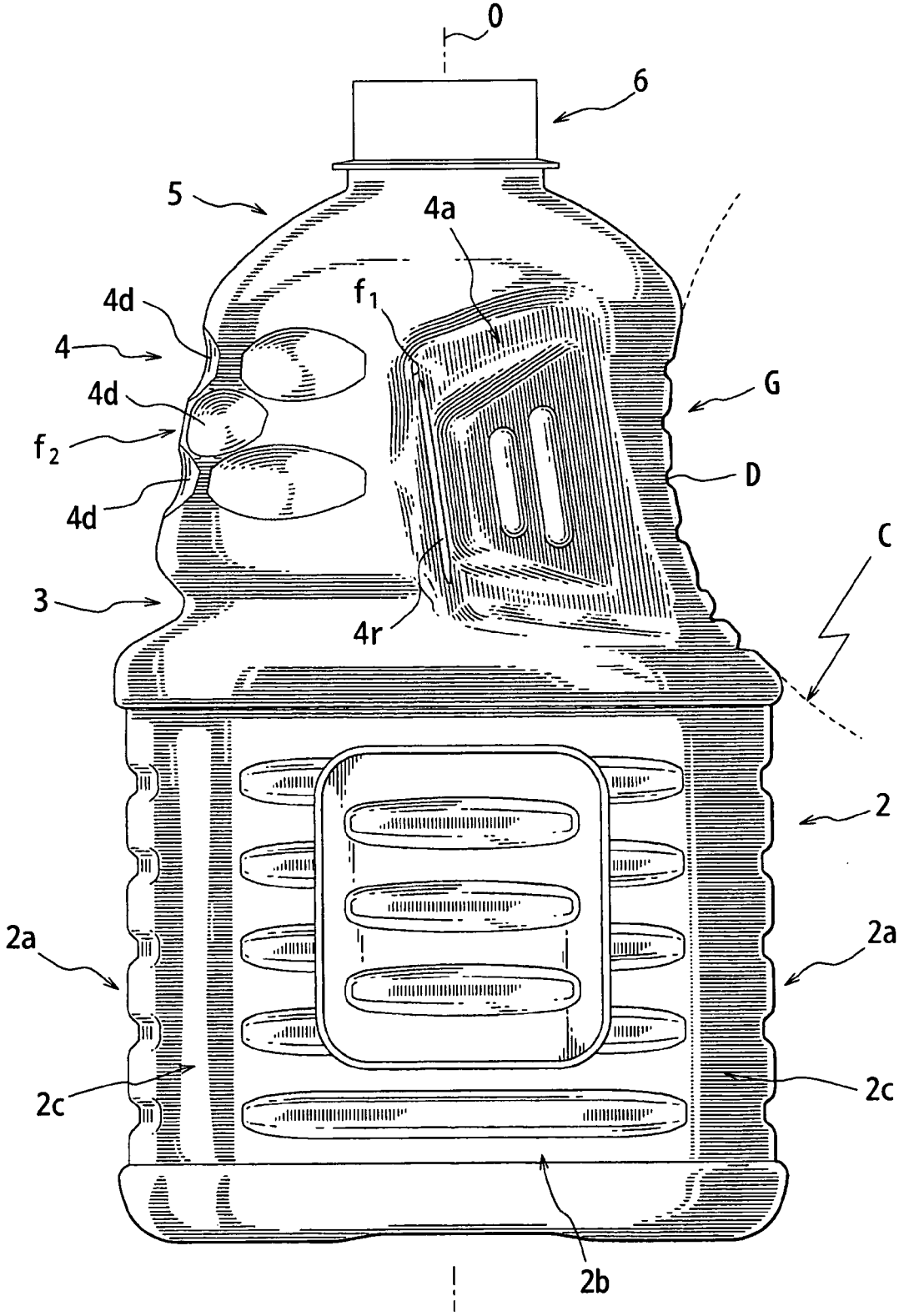
FIG. 3 is a right side view of the PET bottle in accordance with the embodiment.
Figure 4:
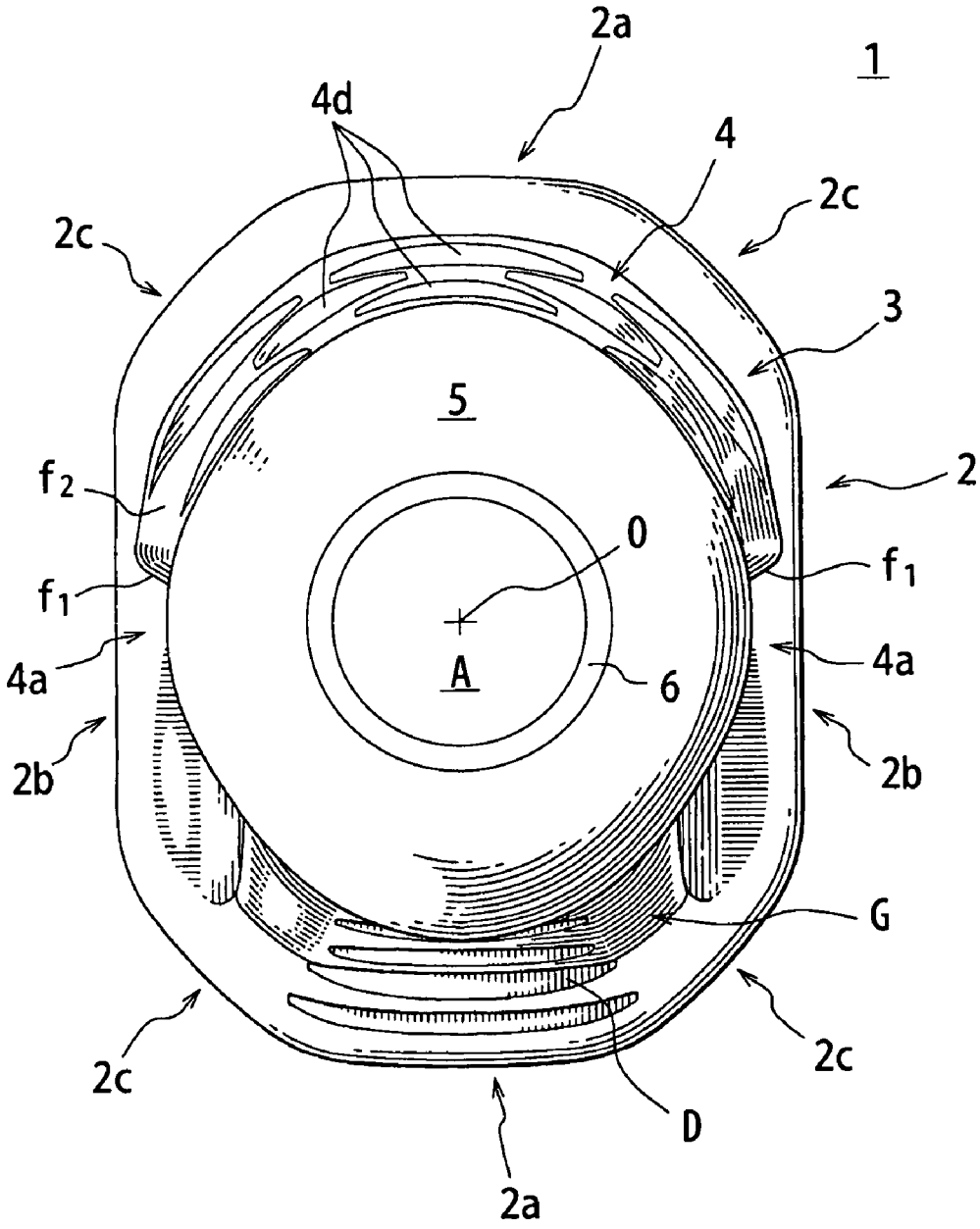
FIG. 4 is a top plan view of the PET bottle in accordance with the embodiment.
Figure 5:
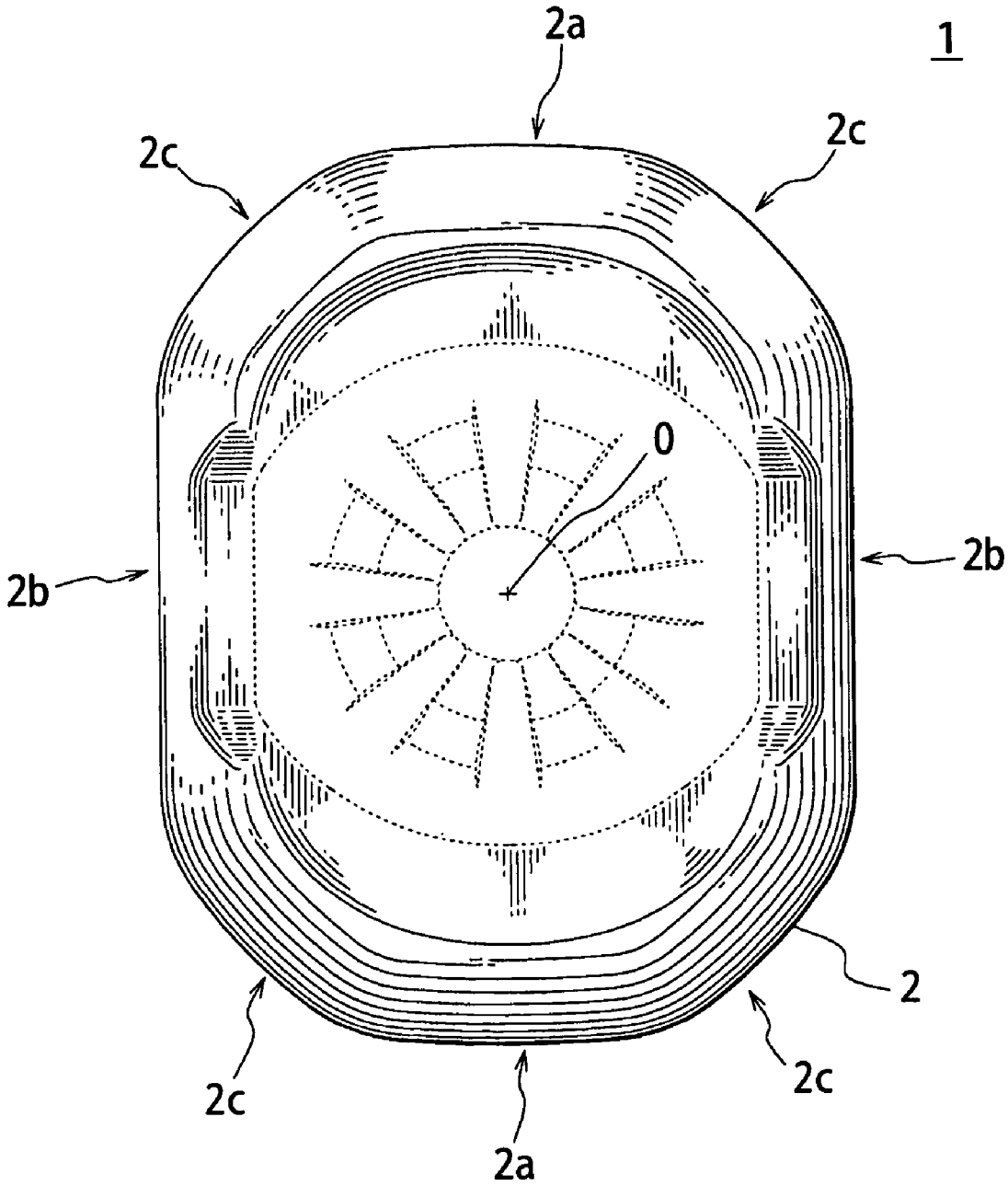
FIG. 5 is a bottom plan view of the PET bottle in accordance with the embodiment.
Figure 6:
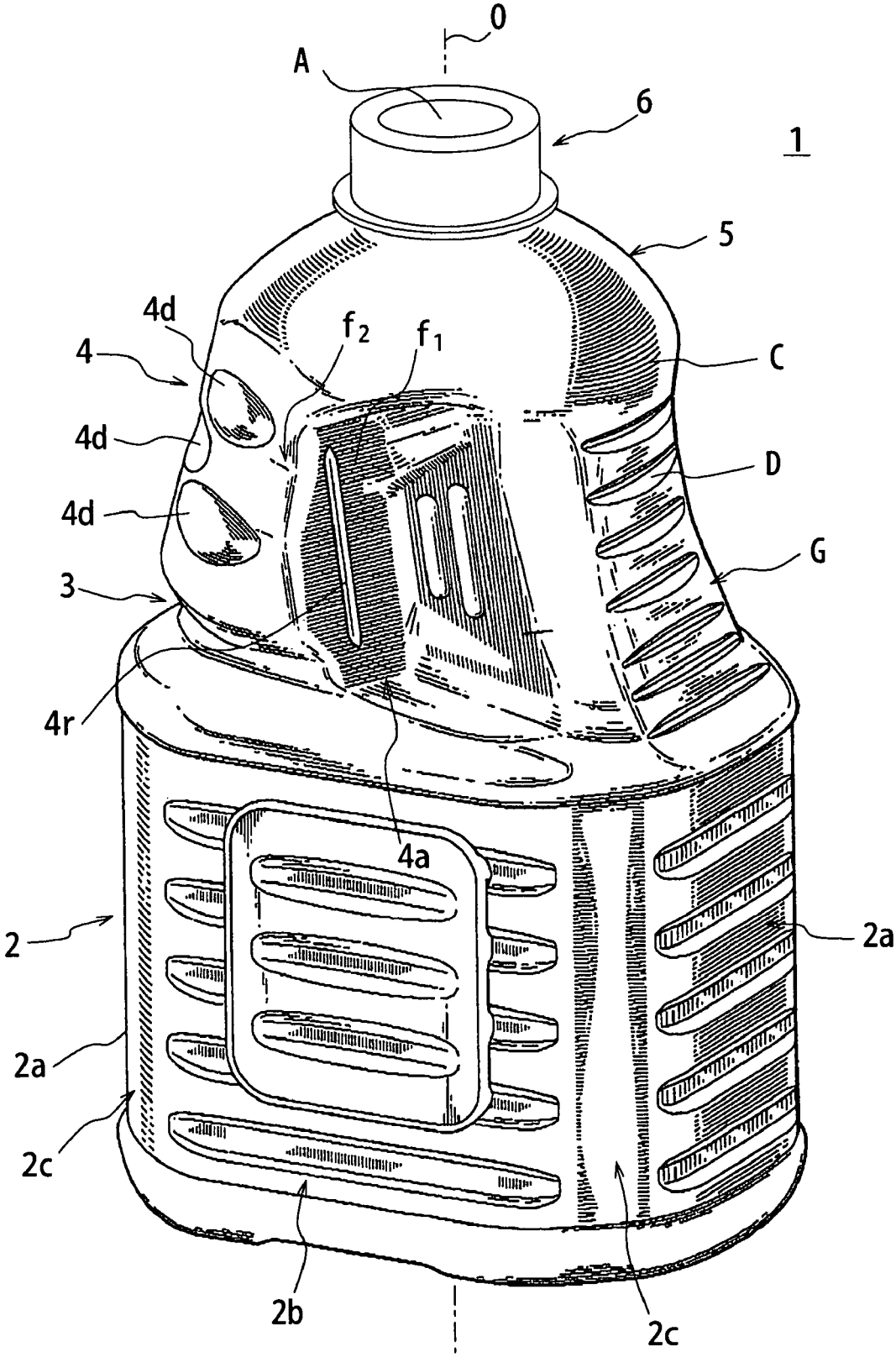
FIG. 6 is a perspective view showing a backside of the PET bottle in accordance with the embodiment.

FIG. 1 is a front view of a PET bottle (hereinafter referred to as "bottle") 1 in accordance with the embodiment of the present invention. FIG. 2 is a rear view of the PET bottle in accordance with the embodiment. FIG. 3 is a right side view of the bottle 1 in accordance with the embodiment. FIG. 4 is a top plan view of the bottle 1 in accordance with the embodiment. FIG. 5 is a bottom plan view of the bottle 1 in accordance with the embodiment. FIG. 6 is a perspective view showing a backside of the bottle 1 in accordance with the embodiment.

The bottle 1 is a single piece article that is shaped from a preform of PET resin by biaxial stretch blow molding process, and reference numeral 2 denotes a lower body portion integrally having a bottom. The lower body portion 2, as shown in FIGS. 4 and 5, has an octagonal prismatic shape that is almost a rectangle having shorter sides 2*a* and longer sides 2*b* at cross section.

Reference numeral 3 denotes a waist which annularly extends along an upper end of the lower body portion and is connected to the lower body portion 2, as shown in FIG. 6, etc.

Reference numeral 4 denotes an upper body portion which annularly extends along an upper end of the waist 3 and is connected to the waist 3, as shown in FIG. 1, etc. The upper body portion 4 has a diameter that is reduced to provide a dome-shape. The maximum external diameter of the upper body portion 4 is smaller than the external diameter of the lower body portion 2, as shown in FIG. 1, etc.

As shown in FIGS. 2 and 3, etc, two depressions 4*a* opposed to each other along its circumferential direction are provided at the rear side of the upper body portion 4. By means of the depressions 4*a* being arranged in a posterior direction, a step surface f1 is provided respectively at each of the front sides of the depressions 4*a*.

One vertical rib 4*r* is provided respectively on each of the step surfaces f1. At least one vertical rib 4*r* of the embodiment is required to be provided for each of the step surfaces f1.

Although the depressions 4*a* of the embodiment are respectively provided over the region from the upper body portion 4 to the waist 3, the depressions 4*a* are required to be provided on at least the region of the upper body portion 4.

The portion which is located between the depressions 4*a* functions as a grip G to be grasped by a user in order to carry the bottle or spout the content.

As shown in FIG. 2, etc, a plurality of transverse grooves D are provided on the back face of the grip G at even intervals along the axial direction O. Although the transverse grooves D of the embodiment are provided over a region from a first diameter-reduced part 4 to the waist 3, the transverse grooves D are required to be provided on at least the region of the upper body portion 4.

Moreover, the shape of the transverse groove D of the embodiment is formed into an approximately oval figure that extends in the circumferential direction with their ends linearly demarcated by vertical lines L1, as shown in FIG. 2.

Furthermore, the transverse groove D of the embodiment is formed that the width of the transverse groove D located at the lower side is larger than the width of the transverse groove D located at the upper side, and the transverse groove D located at the lowest side has the largest width.

When the transverse groove D is provided on the back face of the grip G, the stiffness of the grip G is increased. As a result, when the user grasps the grip G securely, the grip G is prevented from deformation.

Therefore, the portability and operability of the bottle can be further improved due to the provision of the transverse groove D on the back face of the grip G. In this instance, when the volume of the bottle is enlarged, or when the wall thickness of the bottle is reduced, the portability and operability of the bottle remain intact to provide an excellent usability of the bottle.

In the drawing, only one of the transverse grooves is identified by reference character D by way of example, and as for other transverse grooves, indication of the reference character is omitted for the sake of simplicity. Moreover, the transverse groove D may be replaced to a transverse rib. It is noted that the term "groove" or "rib" in conjunction with a PET bottle manufactured basically by blow molding process may be generally interpreted as being limited to a groove or rib with an increased or decreased wall thickness. However, in the context of the present invention, these terms should be given a broader interpretation as encompassing a raised portion or a recessed portion having a substantially uniform thickness.

Furthermore, the shape of the back face of the grip G is formed into a concaved surface C curved along the axial direction O and concaved toward inside of the bottle 1, as shown in FIG. 3, etc.

When the shape of the back face of the grip G is formed into the concaved surface C in this way, it is also possible to further improve the stiffness of the entire grip G. Moreover, when the shape of the back face of the grip G is formed into the concaved surface C, the palm of the user fits the concaved surface C during grasping the grip G.

Therefore, the portability and operability of the bottle can be further improved also by forming the shape of the back face of the grip G into the concaved surface C.

It is noted that, although the concaved surface C of the embodiment is provided over the region from the upper body portion 4 to the waist 3, the concaved surface C is required to be provided on at least the region of the upper body portion 4. Moreover, although the concaved surface C curves at a constant curvature, it may be variable to be a preferred curve for the user, etc.

On the other hand, as shown in FIG. 1, etc, a concave region f2 extending in the circumferential direction and connecting the two depressions 4*a* and concaved toward inside of the bottle 1 is provided at the front side of the upper body portion 4.

A plurality of dimples (recessed portions) 4*d* are provided on the concave region f2. The dimples 4*d* of the embodiment are arranged at even intervals in the circumferential direction and the sets of dimples 4*d* are provided through three stages at even intervals along the axial direction O. The dimples 4*d* of each stage are disposed in a staggered manner to eliminate overlapping with the dimples 4*d* of an adjacent stage.

Moreover, the dimple 4*d* of the embodiment has an approximately oval figure that extends in the circumferential direction with their ends linearly demarcated by vertical lines L2.

In addition, the dimples 4*d* of the embodiment are formed in which the widths of the dimples 4*d* located at the uppermost stage are smaller than the widths of the dimples 4*d* located at the lowest stage, and the dimples 4*d* located at the middle stage have the smallest width.

In the drawing, only one of the dimples of the each stage is identified by reference numeral 4*d* by way of example, and as for other dimples in the stage, indication of the reference numeral is omitted for the sake of simplicity.

Reference numeral 5 denotes a shoulder annularly extending along the upper end of the upper body portion 4 and connected to the upper body portion 4. The shoulder 5 has a diameter that is reduced so that an angle of inclination is reduced.

Reference numeral 6 denotes a tubular neck part connected to the shoulder 5 and having a spout A (refer to FIG. 6).

According to the bottle 1, the two depressions 4*a* opposed to each other in the circumferential direction to define the grip G between the two depressions 4*a* are provided at the rear side of the upper body portion 4, whereby the grip G functions as beam of the upper body portion 4 (inclusive of the waist 3 in this embodiment).

In addition, according to the bottle 1, the vertical rib 4*r* is provided on the step surface f1 formed at each of the front sides of the depressions 4*a*, whereby the vertical ribs 4*r* also function as a beam of the grip, in other words, as a beam of the upper body portion 4.

Therefore, even if a large compression stress is applied along the axial direction of the bottle, the present invention serves to provide an improved strength of the entire upper body portion which otherwise tends to be easily buckled.

In addition, according to the bottle 1, the lower body portion 2 has a prismatic shape, of which each corner 2*c* connecting the shorter sides 2*a* and the longer sides 2*b* functions as a beam of the lower body portion 2. That is to say, according to the bottle 1, the strength of the lower body portion 2 is also secured.

Therefore, according to the present invention, there is provided a PET bottle having easy portability and operability and having high buckling strength, without requiring an additional handle, etc.

It is noted that, in the bottle 1, although the vertical rib 4*r* is provided on each of the step surfaces f1, according to the present invention, the vertical rib 4*r* may be replaced to a vertical groove.

According to the bottle 1, the concave region f2 connecting the two depressions 4*a* is formed at the front side of the upper body portion, and the plurality of dimples 4*d* are provided on the concave region f2, whereby the concave region f2 and dimples 4*d* disperse the compression stress, as a result, the strength against the compression buckling is further increased.

It is noted that, the plurality of dimples 4*d* are provided on the concave region f2 in the bottle 1. However, in context of the present invention, at least one dimple 4*d* is required. In addition, the shape and arrangement of the dimple 4*d* may also be changed in various ways.

In addition, according to the present invention, dimple 4*d* can be replaced to a to raised portion bulged outward from the bottle 1. Also, as discussed previously, the term "raised portion" or "recessed portion" in conjunction with the PET bottle manufactured basically by blow molding process may be generally interpreted as a raised portion or recessed portion with a substantially uniform thickness. However, in the context of the present invention, these terms should be given a broader interpretation as encompassing a rib or groove with an increased or decreased wall thickness.

The present invention has been described above with reference to a preferred embodiment, however, various changes may be made without departing from the scope of the appended claims.

INDUSTRIAL APPLICABILITY

The present invention is applicable to a bottle containing a liquid content, such as chemical, beverage, etc.

The invention claimed is:

1. A synthetic resin bottle including a body having a bottom, in which the body is divided by a waist into an upper body portion and a lower body portion, said synthetic resin bottle comprising:

two depressions each provided at a rear side of the upper body portion and opposed to each other along a circumferential direction to define a grip between the two depressions, and at least one vertical rib or vertical groove each provided on a step surface formed at each of front sides of the depressions, wherein the step surface and the at least one vertical rib or vertical groove are configured and arranged so that the vertical rib or groove face substantially toward the rear side of the upper body portion.

2. The synthetic resin bottle according to claim 1, wherein the lower body portion has a prismatic shape.

3. The synthetic resin bottle according to claim 1, wherein a concave region connecting the two depressions is formed at a front side of the upper body portion, and at least one raised portion or recessed portion is provided on the concave region.

4. The synthetic resin bottle according claim 1, wherein the upper body portion annularly extends along an upper end of the waist and has a diameter that is reduced in a dome-shape.

5. The synthetic resin bottle according to claim 1, wherein at least one transverse groove or transverse rib is provided on a back face of the grip.

6. The synthetic resin bottle according to claim 1, wherein a back face of the grip has a concaved surface curved along an axial direction of the bottle and is thereby concaved toward inside of the bottle.

7. The synthetic resin bottle according to claim 1, wherein each depression has a side wall surface and the step surface, the side wall surface extending from a back face of the grip toward a front side of the upper body portion, the step surface extending from a front end of the side wall surface and being connected to a back end of the front side of the upper body portion.

8. The synthetic resin bottle according to claim 1, wherein the bottle includes a concave region, the concave region extending in the circumferential direction on a front side of the upper body portion and connecting the two depressions and being concave toward inside of the bottle, the concave region includes a plurality of dimples.

* * * * *